United States Patent [19]

Trisolini

[11] Patent Number: 4,561,141

[45] Date of Patent: Dec. 31, 1985

[54] SELF-WRINGING MOP

[76] Inventor: George S. Trisolini, Via Donatello 5, Palagiano (Taranto), Italy

[21] Appl. No.: 562,869

[22] Filed: Dec. 19, 1983

[30] Foreign Application Priority Data

Feb. 16, 1983 [IT] Italy ..... 66302 A/83

[51] Int. Cl.[4] ..... B08B 11/02

[52] U.S. Cl. ..... 15/3; 15/229 A; 15/263

[58] Field of Search ..... 15/3, 116 R, 120 R, 15/120 A, 263, 229 A

[56] References Cited

U.S. PATENT DOCUMENTS 4,344,201 8/1982 Trisolini ..... 15/3
4,464,809 8/1984 Trisolini ..... 15/3

FOREIGN PATENT DOCUMENTS 558295 2/1957 Italy ..... 15/120 A
584319 10/1958 Italy ..... 15/120 A
1300709 12/1972 United Kingdom ..... 15/120 A

*Primary Examiner*—Harvey G. Hornsby
*Assistant Examiner*—Arthur D. Dahlberg
*Attorney, Agent, or Firm*—Samuelson & Jacob

[57] ABSTRACT

A self-wringing mop has a handle with a housing attached, a wringer in the housing including a basket with a perforated wall mounted for rotation in the housing by an electric motor, a wiper, and a manually operated actuator for selectively moving the wiper to an advanced position outside the housing for wiping operations and a retracted position inside the housing and the basket for wringing of the wiper by rotation of the basket.

9 Claims, 4 Drawing Figures

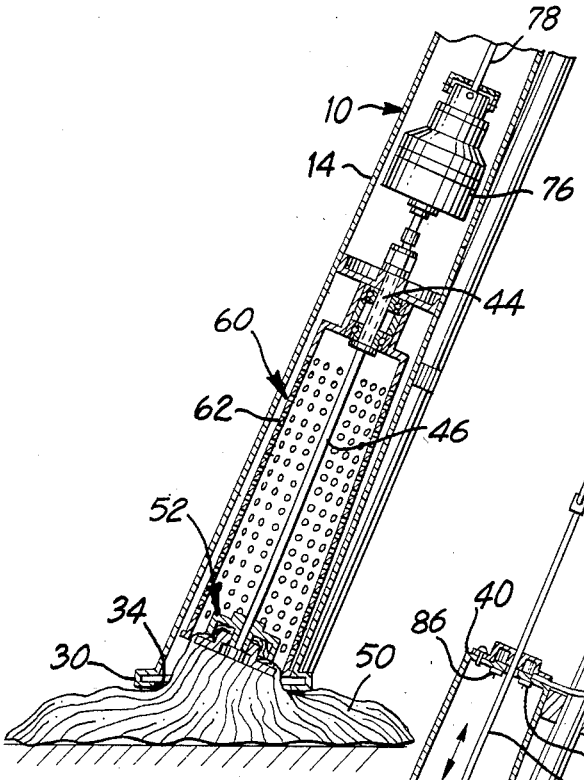
FIG. 2
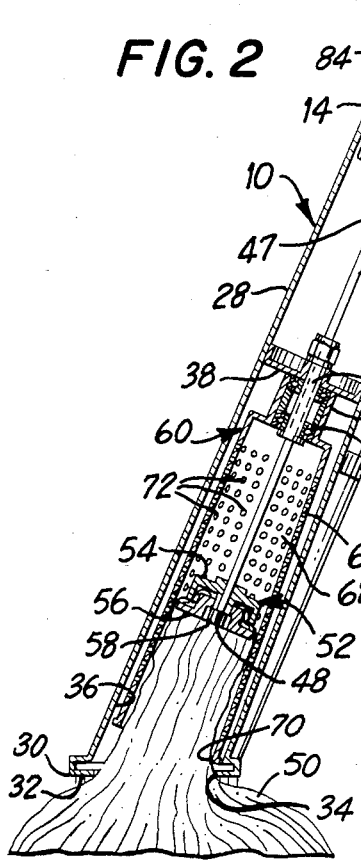
FIG. 1
FIG. 3
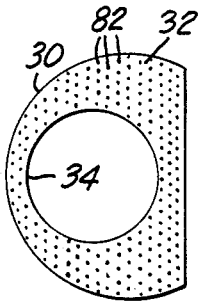
FIG. 4

SELF-WRINGING MOP

The present invention relates generally to cleaning apparatus and pertains, more specifically, to a mop having a wringing feature.

In my earlier patent, U.S. Pat. No. 4,344,201, I disclose a cleaning apparatus in which a mop having a rotatable wiper is wrung by placing the wiper within a wringer basket which is rotated by an electric motor actuated in response to placement of the wiper in the basket. The wringer basket is carried in a housing which also includes a pail for carrying a liquid cleaning medium, such as water, the housing being supported upon casters for ease of maneuvering the apparatus along a floor during use.

It is an object of the present invention to provide a mop in which the wiper is wrung in a fashion similar to that described in my earlier patent, but with a wringer carried by the mop itself.

Another object of the invention is to provide a mop in which wringing is accomplished with increased ease and in a complete and thorough manner without a separate auxiliary wringing device.

Still another object of the invention is to provide a mop with a self-contained wringer for exceptional portability in an effective cleaning implement.

Yet another object of the invention is to provide a mop with an electrically-operated wringer arranged for ease of handling and effective use.

A further object of the invention is to provide a mop which may be wrung effectively with minimum effort.

A still further object of the invention is to provide a mop of the type having a cloth or cloth-like wiper and a wringer of the type which is effective in wringing a cloth or cloth-like wiper, the wringer being combined with the mop in an integral assembly.

The above objects, as well as still further objects and advantages, are attained by the present invention which may be described briefly as a mop comprising: a mop handle; a housing mounted upon the mop handle and having an opening therein; a basket mounted for rotation within the housing, the basket having an axially-extending perforated wall and a mouth adjacent the opening in the housing; a wiper mounted for selective movement between an advanced position outside the housing, where at least a portion of the wiper is located in position for wiping, and a retracted position within the housing, wherein the wiper is located within the basket; actuating means for selectively moving the wiper between the advanced position and the retracted position; and a motor within the housing and coupled with the wiper for rotation of the wiper and the basket when the wiper is in the retracted position such that the wiper is forced against the perforated wall of the basket and matter in the wiper is extracted therefrom through the perforated wall of the basket.

The invention will be understood more fully, while further objects and advantages will become apparent, in the following detailed description of a preferred embodiment illustrated in the accompanying drawing, in which:

FIG. 1 is a longitudinal cross-sectional view of a mop constructed in accordance with the invention, the wiper of the mop being in an intermediate position;

FIG. 2 is a fragmentary view similar to FIG. 1, but showing only a portion of the mop, with the wiper in an advanced wiping position;

FIG. 3 is a fragmentary view similar to FIG. 1, but showing the wiper in a retracted, wringing position; and FIG. 4 is an end view of the lower end of the mop as seen in FIG. 3.

Referring now to the drawing, and especially to FIG. 1 thereof, a mop constructed in accordance with the invention is illustrated at 10 and is seen to have an elongate handle 12 carrying a housing 14. Handle 12 passes through a brace 16 which is integral with housing 14 and is threaded into a collar 18, also integral with housing 14, to secure the housing 14 and handle 12 together in a single assembly. For ease of storage and transportation, handle 12 is in two sections 20 and 22 coupled together at threaded coupling 24. A pair of cleats 26 are affixed to the handle 12 at longitudinally spaced apart locations for purposes which will be described below.

Housing 14 includes a wall 28 and carries at the lower end 30 thereof a base 32 having an opening 34 therein. A lower chamber 36 in the housing 14 extends between the opening 34 and a web 38 affixed to wall 28 of the housing 14 intermediate the lower end 30 and upper end 40 of housing 14. An upper chamber 42 extends between the web 38 and the upper end 40. A central, longitudinally-extending sleeve 44 is carried by web 38 and an elongate shaft 46 is received within sleeve 44 for rotation in the sleeve 44 and for longitudinal sliding movement relative to sleeve 44 and web 38. Shaft 46 extends longitudinally between an upper end 47 and a lower end 48.

A wiper 50 is secured to the lower end 48 of shaft 46 by means of a clamping assembly 52 which includes an upper clamp member 54 and a lower clamp member 56. The central portion of wiper 50 is clamped between the upper and lower clamp members 54 and 56, which are retained in place by a threaded fastener 58. Wiper 50 is illustrated in the form of a cloth wiper; however, other wiping materials may be employed for wiper 50 and several alternatives will become apparent to those skilled in the cleaning arts.

Located within the lower chamber 36 of housing 14 is a wringer assembly 60 including a basket 62 having an integral neck 64 within which there is located a bearing assembly 66 which journals the basket 62 for rotation relative to web 38. Basket 62 includes a cylindrical wall 68 extending downwardly from neck 64 to a lower open mouth 70 located adjacent opening 34 of housing 14. A plurality of perforations 72 pass through cylindrical wall 68.

At the upper end 47 of shaft 46, a coupling 74 couples an electric motor 76 with shaft 46. A rod 78 is affixed to electric motor 76 and extends upwardly through the upper end 40 of housing 14 to a handgrip 80 located at the end of rod 78 opposite coupling 74. Rod 78 is selectively slidable upwardly and downwardly, and by manually gripping the handgrip 80 and moving the rod 78 to locate the electric motor 76 in selected positions within the upper chamber 42 of housing 14, rod 78 and handgrip 80 serve as actuating means.

Thus, as best seen in FIG. 2, when rod 78 is pushed downward, shaft 46 slides within sleeve 44 until coupling 74 is seated against sleeve 44. Shaft 46 has then been advanced to the position where wiper 50 extends beyond opening 34 in the base 32 of housing 14 and is available for wiping operations. During such operations, wiper 50 normally is immersed within a cleaning liquid and then is spread beneath base 32. A plurality of spikes 82 project downwardly from the base 32, as seen in FIGS. 3 and 4, and engage the wiper 50 in the spread-out configuration of the wiper to aid in retaining the spread-out configuration during wiping of the surface to be cleaned. In this configuration mop 10 may be used as a conventional mop.

When it is desired to wring the wiper 50 of mop 10, handgrip 80 is gripped and pulled upwardly to retract rod 78 and shaft 46. In the fully retracted position illustrated in FIG. 3, wiper 50 is drawn into basket 62 of wringer assembly 60. At the same time, electric motor 76 is moved upwardly within upper chamber 42 to upper end 40 of housing 14. Electric motor 76 carries electrical contact elements 84 which engage and make electrical contact with complementary electrical contact elements 86 located in the upper end 40 of the housing 14. Electrical contact elements 86 are connected to a line cord 88 which, in turn, is connected to a source of electrical power. Upon full retraction of the wiper 50 into basket 62 and contact between complementary electrical connector elements 84 and 86, electric motor 76 will be energized and thus actuated to rotate shaft 46, thereby rotating and throwing wiper 50 radially outwardly against the perforated wall 68 of basket 62. Basket 62 thus will be coupled for rotation with shaft 46 and wiper 50 and cleaning liquid will be urged out of wiper 50 to pass through the perforations 72 in the wall 68 of the basket 62. The cleaning liquid thus wrung from the wiper 50 will collect along the wall 28 within the lower chamber 36 of housing 14 and will drain out of opening 34. Upon completion of the wringing operation, handgrip 80 is advanced to the position shown in FIG. 2 and the mop 10 is again ready for wiping.

In order to retain line cord 88 neatly in place, the line cord 88 may be wrapped about cleats 26, either during storage or use.

Mop 10 offers a relatively simple and effective construction for cleaning all surfaces where mops usually are used. Wringing is accomplished with ease and the liquid wrung from the wiper of the mop is contained during wringing and readily directed to a selected location.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A mop comprising:

a mop handle;

a housing mounted upon the mop handle and having an opening therein;

a basket journaled for rotation within the housing, the basket having an axially-extending perforated wall and a mouth adjacent the opening in the housing;

a wiper mounted for rotation upon the mop handle and for selective movement relative to the mop handle, the basket and the housing between an advanced position outside the housing, where at least a portion of the wiper is located in position for wiping, and a retracted position within the housing, wherein the wiper is located within the basket;

actuating means mounted upon the mop handle for selectively moving the wiper between the advanced position and the retracted position; and a motor within the housing and coupled with the wiper for rotation of the wiper when the wiper is in the retracted position such that the wiper is forced against the perforated wall of the basket to couple the basket for rotation with the wiper in the same direction of rotation as the rotation of the wiper and matter in the wiper is extracted therefrom through the perforated wall of the basket.

2. The invention of claim 1 wherein the housing includes a base, the opening in the housing is located at the base, and the mouth of the basket is adjacent the base.

3. The invention of claim 2 wherein the actuating means includes a shaft extending longitudinally between opposite ends and mounted in the housing for sliding movement along a longitudinal axis and for rotation about the longitudinal axis, the wiper is affixed to the shaft adjacent one end thereof and the motor is coupled to the shaft adjacent the other end thereof.

4. The invention of claim 3 wherein the motor is an electric motor and the mop includes energizing means for energizing the motor when the shaft is located so as to place the wiper in the retracted position.

5. The invention of claim 4 wherein the energizing means includes complementary electrical contacts which make electrical contact in response to placement of the wiper in the retracted position.

6. The invention of claim 3 wherein the actuating means includes a handgrip coupled with the shaft for selective manual movement of the wiper between the advanced position and the retracted position.

7. The invention of claim 6 wherein the motor is an electric motor and the mop includes energizing means for energizing the motor when the shaft is located so as to place the wiper in the retracted position.

8. The invention of claim 1 wherein the motor is an electric motor and the mop includes energizing means for energizing the motor when the actuating means is actuated to place the wiper in the retracted position.

9. The invention of claim 8 wherein the motor is coupled for movement with the wiper as the wiper is moved between the advanced position and the retracted position and the energizing means includes complementary electrical contacts which make electrical contact in response to placement of the wiper in the retracted position.

* * * * *